United States Patent [19]

Pareja

[11] Patent Number: 4,721,444

[45] Date of Patent: Jan. 26, 1988

[54] FLUID PUMP INCORPORATING PULSATION DAMPENER SURROUNDING ITS SHAFT

[75] Inventor: Ramon Pareja, Edina, Minn.

[73] Assignee: Hypro Corp., St. Paul, Minn.

[21] Appl. No.: 938,969

[22] Filed: Dec. 8, 1986

[51] Int. Cl.[4] ..... F04B 11/00

[52] U.S. Cl. ..... 417/540; 417/273; 138/30

[58] Field of Search ..... 417/540, 542, 541, 273; 138/30

[56] References Cited

U.S. PATENT DOCUMENTS

| | | | |
|---|---|---|---|
| 2,875,788 | 3/1959 | Pier | 138/30 |
| 3,292,733 | 12/1966 | Everett et al. | 138/30 X |
| 3,378,036 | 4/1968 | Clayton | 138/30 |
| 4,033,707 | 7/1977 | Stutzman | 417/540 X |
| 4,381,179 | 4/1983 | Pareja | 417/273 |
| 4,571,159 | 2/1986 | Beardmore | 417/540 X |

FOREIGN PATENT DOCUMENTS

| | | | |
|---|---|---|---|
| 2212322 | 9/1973 | Fed. Rep. of Germany | 417/540 |

*Primary Examiner*—Carlton R. Croyle

*Assistant Examiner*—Eugene L. Szczecina, Jr.

*Attorney, Agent, or Firm*—Orrin M. Haugen; Thomas J. Nikolai; Frederick W. Niebuhr

[57] ABSTRACT

A high pressure fluid handling pump of the type having a drive shaft for connection to a drive motor where the drive shaft extends longitudinally through a pulsation dampener affixed to the pump's housing. The pulsation dampener comprises a cup-shaped housing having a pump shaft receiving bore extending through an end wall thereof and which, when secured to the motor housing, defines a hollow chamber in fluid communication with the pump's outlet. Disposed within the hollow chamber of the pulsation dampener housing and concentric with the motor's shaft is a rigid baffle member. Surrounding that is a tubular diaphragm formed from an elastomeric material of a predetermined durometer hardness, the tubular diaphragm effectively dividing the hollow chamber into two compartments isolated from one another. One compartment is exposed to the pressure surges occurring in the fluid being pumped through slits formed in the baffle member and the other compartment is pressurized by a compressible fluid to a predetermined pressure value.

2 Claims, 2 Drawing Figures

FLUID PUMP INCORPORATING PULSATION DAMPENER SURROUNDING ITS SHAFT

BACKGROUND OF THE INVENTION

I. Field of the Invention:

This invention relates generally to high pressure fluid handling pumps and more particularly to the design of such a pump in which a pulsation dampener is designed to attach to the pump housing with the pump's shaft extending through it.

II. Discussion of the Prior Art:

In fluid handling systems in which positive displacement pumps are employed, a need often exists for a pulsation dampener to suppress pressure surges in the fluid being pumped occasioned by the reciprocating motion of the pump's piston or diaphragm, as the case may be. A typical prior art pulsation dampener typically comprises a ball-shaped housing whose two hemispheres are secured together by bolts or the like and a rubber diaphragm effectively divides the chamber or cavity within the housing into two compartments. The first compartment is exposed to pressure surges in the fluid exiting the pump's outlet port while the other compartment is filled with a compressible fluid to a predetermined pressure. The appearance of a typical surge suppressor can be seen upon reference to the Burton U.S. Pat. No. 4,186,776. When a device of this configuration is operatively attached to the pump with which it is to be used, it generally tends to be somewhat unsightly and, moreover, in many applications, physical space requirements may preclude the use of such an appendage.

In my co-pending application, U.S. Ser. No. 939,010 and entitled "SURGE SUPPRESSOR", filed on even date herewith and incorporated herein by reference, there are described two preferred embodiments of a surge suppressor which are of a significantly different geometry than prior art designs and which possesses characteristics which afford a prolonged mean-time-between-failure of the bladder or diaphragm used in them.

The present invention is directed to the combination of a fluid handling pump and a surge suppressor similar in design to the embodiments in my above-referenced co-filed application in which the surge suppressor is secured to the pump's housing, forming a part thereof and with the pump's shaft physically passing directly through the surge suppressor. This arrangement not only provides the advantages set out in my co-filed application referenced above but offers a more aesthetic appearance to the combination as well as a more compact arrangement which can accommodate tighter space specifications in many applications.

OBJECTS

It is accordingly a principal object of the present invention to provide an improved combination of a fluid handling pump and associated surge suppressor.

Another object of the invention is to provide a surge suppressor for a pump which can be coaxially disposed relative to the pump's drive shaft.

Another object of the invention is to provide a pump incorporating a surge suppressor as a component part thereof where the surge suppressor surrounds the pump's output shaft so as to avoid obtrusive appearing appendages on the pump.

Still another object of the invention is to provide in combination with a positive displacement pump, a surge suppressor having a bladder member with a unique design which avoids undue wear and, therefore, a longer useful life.

SUMMARY OF THE INVENTION

In accordance with the present invention, the foregoing objects and advantages are achieved by providing a multicylinder, positive-displacement pump having a pump housing defining a crankcase and a cylinder head secured to the pump housing and containing a reciprocally movable member, e.g., a piston or diaphragm. The pump's drive shaft extends through the housing and is journaled for rotation therein. The shaft also has an eccentric segment integrally formed thereon, that segment being physically disposed within the crankcase and a suitable connecting rod assembly joins the reciprocally movable members up and down within their respective cylinder heads upon rotation of the pump's drive shaft.

Formed in the cylinder head is a fluid inlet manifold and disposed in series flow relationship with the manifold for each cylinder head is an inlet valve of the poppet type which opens to draw fluid into the cylinder upon the suction stroke of the piston or diaphragm and which closes during the pressure stroke. Similarly, an outlet manifold couples all of the cylinder heads and includes an outlet poppet valve which closes during the suction stroke and which opens during the pressure stroke.

Attached to the pump housing proximate its drive shaft is a surge suppressor in the form of a rigid, cup-shaped housing having a shaft receiving bore formed in an end surface thereof. The cup-shaped housing defines a cavity which abuts the outlet manifold of the pump. Disposed within the cavity is a rigid tubular baffle member having a central bore formed therethrough for receiving the pump's shaft. The tubular baffle has a plurality of radially spaced bores extending only partially through the length dimension of the tubular walls of the baffle. A series of longitudinally spaced, radial slots are formed through the side wall of the baffle to communicate with the radially arranged bores.

Completing the surge suppressor is an elastomeric, generally tubular diaphragm having a pair of opposed end surfaces which are appropriately clamped between the baffle and the cup-shaped housing in a sealed fashion. The concentric arrangement of the tubular diaphragm, the rigid tubular baffle and the pump's shaft allows the pump shaft to pass completely through the surge suppressor.

The elastomeric diaphragm effectively divides the chamber in the cup-shaped housing into two compartments, one of which is exposed to the pressure surges present in the pump's outlet chamber while the other compartment is filled with a pressurizing fluid tending to restrain the deflection of the elastomeric diaphragm member when the pressure waves in the working fluid exceed the pressure of the gas-filled chamber. By conforming the outer dimensions of the surge suppressor with the corresponding dimensions of the pump housing to which it is attached, the presence of the surge suppressor is relatively unnoticeable. Furthermore, it does not significantly add to the bulk-dimensions of the pump housing.

DESCRIPTION OF THE DRAWINGS

The above objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
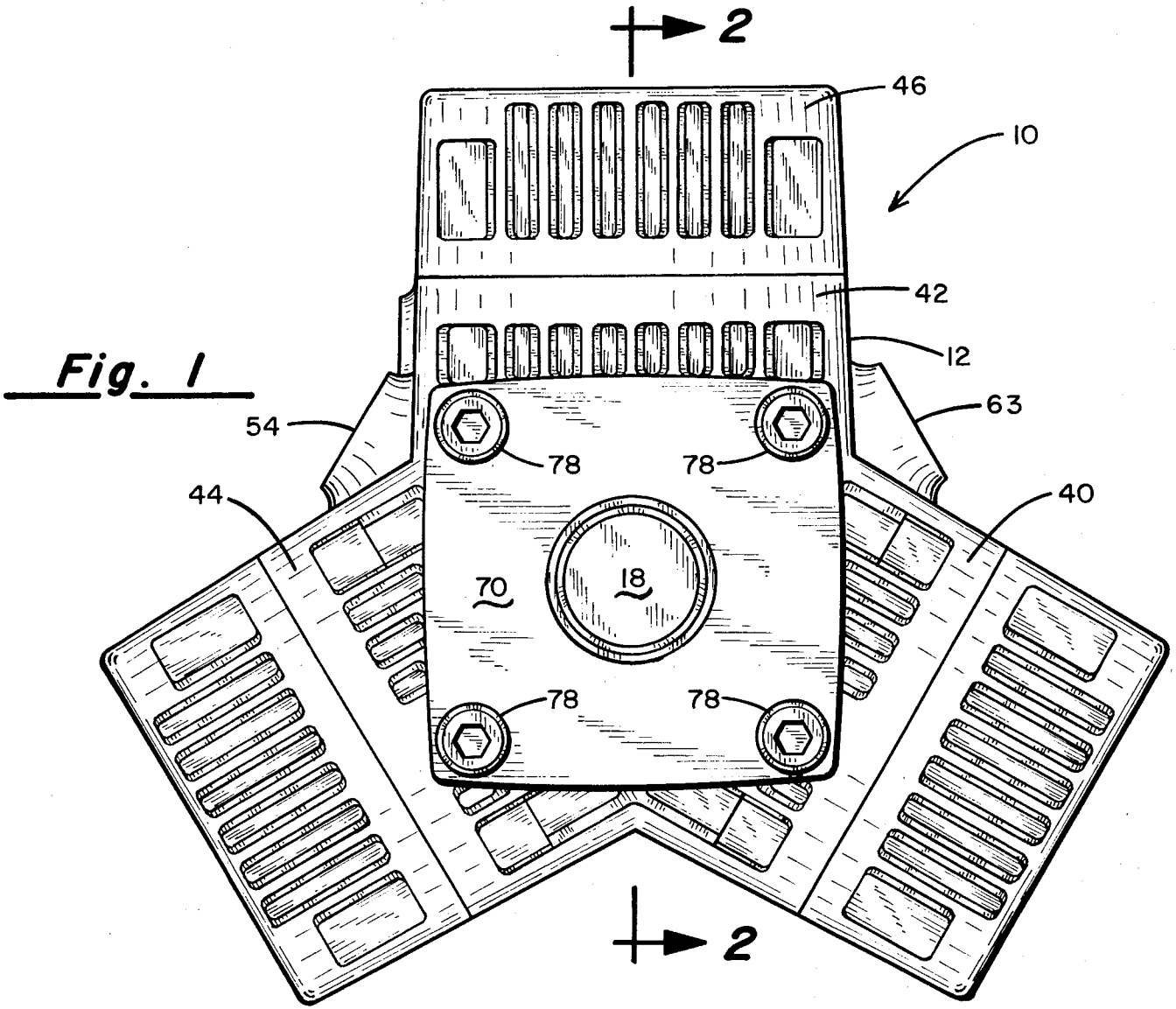
FIG. 1 is an end view of a multi-cylinder, positive-displacement pump equipped with a surge suppressor in accordance with the present invention.
Figure 2:
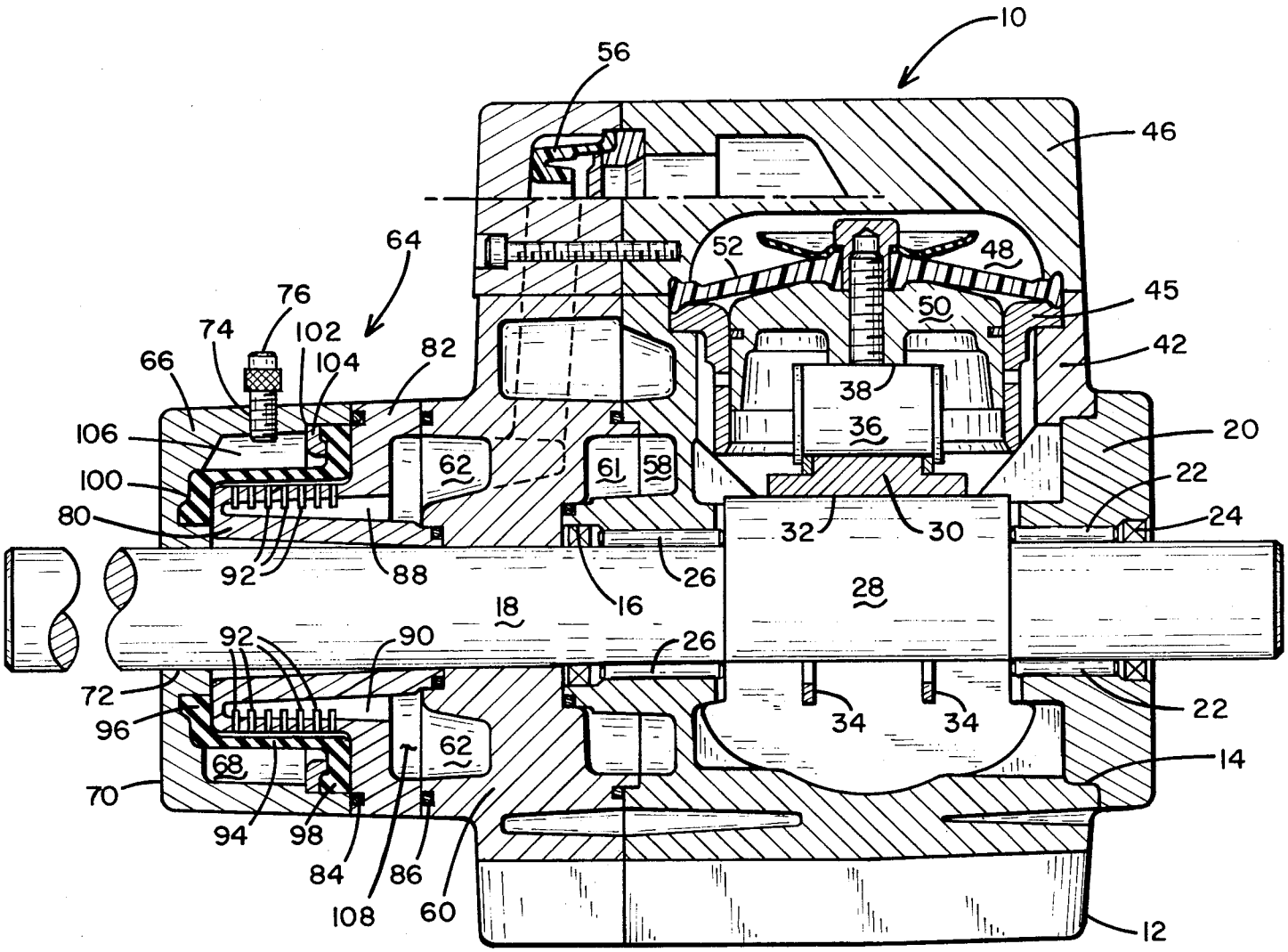
FIG. 2 is a cross-sectional view taken along the lines 2—2 in FIG. 1.

Referring to FIGS. 1 and 2, identified by numeral 10 is a multi-cylinder pump which, for purposes of illustration only, is depicted as a three-cylinder diaphragm pump somewhat similar to that shown in my earlier U.S. Pat. No. 4,381,179. It is understood, however, that the present invention may likewise be used with a piston-type pump like that also depicted in U.S. Pat. No. 4,381,179. The pump includes a crankcase housing 12 which is cast or otherwise formed. The crankcase housing includes axially aligned bores 14 and 16 and extending through those bores and journaled for rotation therein is a crank shaft 18. More particularly, inserted into the bore 14 in the crankcase housing is a crankcase cover 20 which serves as an outer race for a plurality of needle bearings 22 and a suitable shaft oil seal 24. The shaft is supported at its other end by bearings 26 also positioned within the crankcase housing. The shaft 18 includes an eccentric 28 contained within the crankcase proper is an eccentric 28.

Disposed at an angle of 120° with respect to one another are three connecting rod members as at 30, each with an arcuate surface 32 curved concavely to conform with the outside diameter of the eccentric portion 28 of the crank shaft 18. The three connecting rods (only one of which is shown in FIG. 2) are held together by retainer rings 34, which surround all of the connecting rods and cooperate with a generally cylindrical floating wrist pin 36 having a flat 38 formed on a surface thereof. The floating wrist pins are held in place in the connecting rods 30 in the fashion described in my aforereferenced U.S. Pat. No. 4,381,179.

The crankcase housing 12 also incorporates three radially extending cylinder block portions 40, 42 and 44 and located in the interior thereof are cylinder sleeves 45. Attached to the outer planar surfaces of the cylinder blocks 42 are cylinder heads 46, each cylinder head 46 defining a hollow chamber 48 with its associated cylinder block. Bolted to the flat surface 38 of the wrist pin 36 is a piston 50 which is arranged to reciprocate back-and-forth as the shaft 18 is rotated due to eccentric 28. Supported by the piston 50 is a pumping diaphragm 52.

The pumping chamber 48 is in fluid communication with the pump's inlet port 54 by way of an inlet manifold leading to the pumping chamber of each of the cylinders. Disposed between the inlet port and each of the pumping chambers is an inlet poppet valve, which cannot be seen in the cross-sectional view of FIG. 2. During the suction stroke of the pumping diaphragm 52, the fluid to be pumped is drawn in through the inlet valve, but upon the onset of the pressure stroke of the diaphragm 52, the poppet valve closes to preclude the fluid from being forced back out of the inlet port.

Associated with the pumping chamber 48 is an inlet manifold communicating with each such pumping chamber on the plural cylinders 40, 42 and 44. A portion of the inlet manifold can be seen in the cross-sectional view of FIG. 2 and is identified by numeral 58.

A manifold plate 60 is secured to the crankcase housing 12 and formed therein is an inlet chamber 61 abutting the inlet portion 58 in the crankcase 12. The manifold plate inlet chamber 61 is in fluid communication with the inlet port 54. The pumping chamber 48 is also in fluid communication with the pump's outlet port 63 shown in FIG. 1 by way of an outlet manifold leading to the pumping chamber of each cylinder. Disposed between the outlet port and each of the pumping chambers is an outlet poppet valve, one of which is partially shown in the cross-sectional view of FIG. 2. It is identified by the numeral 56. During the outlet stroke of the diaphragm 52, the fluid to be pumped is forced through the outlet valve 56 and to the groove 62 which is also in fluid communication with the pump outlet port 63 shown in FIG. 1. Pressure surges occurring in the pump's outlet are thus also reflected in the annular groove 62.

Completing the pump assembly is a surge suppressor or pressure dampener indicated generally by numeral 64. It is seen to include an outer, cup-shaped cover member 66 defining a hollow chamber 68. The end 70 of the cover 66 is provided with a bore 72 of a size permitting the shaft 18 to extend therethrough. An internally threaded bore 74 also extends through the side wall of the cup-shaped cover 66 and fitted therein is an in-line inflation check valve 76.

When the cup-shaped cover 66 is attached to the manifold plate 60 by fasteners 78, the hollow chamber 68 abuts the annular groove 62 formed in the manifold plate and, thus, is in fluid communication therewith.

Disposed within the confines of the chamber 68 is a rigid diffuser or baffle member 80 in the form of a generally cylindrical block having an outwardly extending flange 82 integrally formed therewith which is adapted to be clamped between the cup-shaped pulsation dampener cover member 66 and the planar front surface of the manifold plate 60. Further details of the construction of the baffle or diffuser member 80 can be obtained from reading the co-filed application previously referenced. O-rings 84 and 86 may conveniently be used to provide an appropriate fluid-tight seal between these mating surfaces and the ambient.

Formed longitudinally and inwardly into the cylindrical wall of the baffle member 80 are a series of radially spaced tapered openings as at 88 and 90 in FIG. 2. These bores do not extend all the way through the length dimension of the rigid baffle member 80 and the open end thereof is in fluid communication with the manifold 62 which joins with the pump's outlet port 63.

Extending through the outer wall surface of the rigid baffle member 80 are a series of slits 92 through which the fluid being pumped may pass. These slits cooperate with the internal surface of a generally cylindrical tubular diaphragm or bladder member 94 to diffuse the fluid flowing therethrough and effectively spreading the pressure over the surface of the diaphragm. As can be seen from the cross-sectional view of FIG. 2, the diaphragm or bladder member 94 has an internally projecting end flange 96 and an outwardly extending flange portion 98 at its other end.

An annular groove 100 is formed in the internal surface of the end portion 70 of the cup-shaped cover 66 for receiving the flange 96 therein and when the fasteners 78 are tightened down, the rubber diaphragm or bladder 94 is clamped in a fluid sealing relationship with the end edge surface of the rigid baffle member 80 and the pulsation dampener cover 66. In a somewhat similar fashion, the flange 98 of the bladder 94 is trapped between the outwardly extending flange 82 of the rigid baffle member 80 and a shoulder 102 formed in the internal side surface of the cup-shaped cover 66 through an intermediate clamping ring 104.

When the end flanges 96 and 98 of the tubular diaphragm 94 are thus clamped, the diaphragm effectively divides the chamber 68 into two fluid-isolated compartments 106 and 108. Only compartment 108 is in fluid communication with the outlet manifold groove 62 formed in the face plate so as to receive the fluid being pumped therein. The compartment 106 is pressurized through the one-way valve 76 with a suitable compressible fluid, such as nitrogen gas. The inflation pressure is preferably about one-half the expected average working pressure of the fluid being pumped.

As it is well known by those familiar with the design, manufacture and use of fluid pumping systems during the pumping cycle, pressure impulses are developed and it is the purpose of the surge suppressor 64 to alleviate the impulse so created. The inner surface of the diaphragm 94 is exposed to the pressure surges in the working fluid via the slits 92 in the diffuser which extend into the tapered bores, such as 88 and 90, and spread the fluid forces relatively evenly over the inner surface of the diaphragm. These pressure impulses tend to cause the diaphragm to bulge radially outwardly against the force exerted by the compressible gas contained within the chamber 106.

Because of the concentric relationship between the pump's shaft 18, the pulsation dampener cover 66, the rigid baffle 88 and the diaphragm 94, the pulsation dampener can be positioned about the shaft 18, allowing the dampener to conform to the outer contours of the pump with which it is used. This greatly improves the aesthetic appearance of the entire assembly and also gives a profile which can fit into tighter confines.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. In a fluid handling system of the type including a pump including a pump housing and having a motor-drivable shaft journaled for rotation in said housing, said pump receiving a working fluid at a first pressure and delivering said working fluid at an outlet at a second substantially higher pressure, the improvement comprising:

a pulsation dampener including a rigid, cup-shaped cover member attached to said housing and defining a hollow cavity and having a pump shaft receiving bore extending through an end wall thereof, a portion of said cavity being in fluid communication with said outlet;

a rigid baffle member located in said cover member concentric with said motor drivable shaft and having perforations over a portion of its surface;

a tubular diaphragm concentrically surrounding said baffle member to effectively divide said hollow cavity into two compartments, one of said compartments being exposed to said portion of said cavity through said perforations; and means for pressurizing the other of said two compartments to a predetermined positive pressure.

2. An improved fluid handling pump comprising:

(a) a pump housing defining a crankcase, a fluid inlet port and a fluid outlet port;

(b) a pump drive shaft journaled for rotation in said pump housing and including an eccentric disposed within said crankcase;

(c) at least one cylinder block secured to said pump housing and containing a reciprocally movable member;

(d) connecting rod means operatively coupling said eccentric and said reciprocally moving member for reciprocally moving said movable member within said cylinder block upon rotation of said shaft; and (e) pulsation dampener means affixed to said pump housing having an interior portion thereof in fluid communication with said outlet port and with a portion of said drive shaft extending through said pulsation dampener means, said pulsation dampener means including (i) a cup-shaped cover member formed from a rigid material and having a pump shaft receiving bore extending through an end wall thereof, the interior of said cup-shaped cover member defining a hollow cavity, said cup-shaped housing being secured to said pump housing such that a portion of said cavity is in fluid communication with said outlet port;

(ii) a tubular baffle member formed from a rigid material disposed within said cup-shaped cover member concentric with said pump drive shaft, said baffle member having perforations over a portion of its surface;

(iii) a tubular diaphragm concentrically surrounding said baffle member, said tubular diaphragm being sealed at each end between said baffle member and said cup-shaped cover member to effectively divide said hollow cavity into two compartments, one of said compartments being exposed to said portion of said cavity through said perforations; and (iv) means for pressurizing the other of said compartments to a predetermined positive pressure less than the average fluid pressure in said outlet port.

* * * * *